US008615950B1

(12) United States Patent
Gomes

(10) Patent No.: US 8,615,950 B1
(45) Date of Patent: Dec. 31, 2013

(54) SYSTEMS AND METHODS OF REDUCING STUCCO CRACKS AT DOORS AND WINDOWS

(71) Applicant: Harold Furtado Gomes, San Juan Bautista, CA (US)

(72) Inventor: Harold Furtado Gomes, San Juan Bautista, CA (US)

( * ) Notice: Subject to any disclaimer, the term of this patent is extended or adjusted under 35 U.S.C. 154(b) by 0 days.

(21) Appl. No.: 13/769,536

(22) Filed: Feb. 18, 2013

(51) Int. Cl.
*E04G 23/02* (2006.01)

(52) U.S. Cl.
USPC ..... 52/514.5; 52/255; 52/741.3; 52/443; 52/454

(58) Field of Classification Search
USPC ..... 52/254–256, 514, 514.5, 741.3, 741.41, 52/443, 454; 428/80, 131
See application file for complete search history.

(56) References Cited

U.S. PATENT DOCUMENTS

| | | | | | |
|---|---|---|---|---|---|
| 1,355,756 | A | | 10/1920 | Earley | |
| 2,442,929 | A | * | 6/1948 | Marino | 52/85 |
| 4,490,953 | A | * | 1/1985 | Meola | 52/211 |
| 4,651,488 | A | | 3/1987 | Nicholas | |
| 5,699,638 | A | * | 12/1997 | Maylon | 52/86 |
| 5,820,958 | A | * | 10/1998 | Swallow | 428/42.2 |
| 6,131,867 | A | * | 10/2000 | Mallek | 248/261 |
| 6,231,949 | B1 | * | 5/2001 | Hoffmann, Sr. | 428/139 |
| 6,601,361 | B2 | * | 8/2003 | Seibert | 52/698 |
| 7,874,123 | B2 | | 1/2011 | Maziarz | |
| 8,024,903 | B2 | * | 9/2011 | Riggs | 52/514 |
| 2003/0215603 | A1 | * | 11/2003 | Lee | 428/134 |
| 2004/0168387 | A1 | | 9/2004 | Nelson | |

FOREIGN PATENT DOCUMENTS

DE 29611225 U1 * 10/1997

OTHER PUBLICATIONS

Crack Policy, Technical Bulletin 4, Plaster Counsel (May 2008) 2402 Vista Nobleza, Newport Beach CA 92660.
Base and Mesh Systems for Crack Reduction, Stucco Manufacturers Association (Mar. 2011) Newport Beach CA.
Technical Bulletin 107, Division 9 Finishes, Stucco and Plaster , revised Dec. 10, 2009 Merlex Stucco Inc, Orange CA.

* cited by examiner

*Primary Examiner* — Robert Canfield
*Assistant Examiner* — Babajide Demuren
(74) *Attorney, Agent, or Firm* — Steven A. Nielsen; Allman & Nielsen, P.C.

(57) ABSTRACT

Various corner element embodiments, 100, 700 may comprise various concentric circle attributes useful in stopping or reducing cracks in stucco and related building materials. The corner element embodiments may be secured at widow and door corner areas and then integrated with traditional stucco applications. The concentric circle attributes and other corner element attributes dissipate stucco movement to reduce stucco heave and cracks.

15 Claims, 8 Drawing Sheets

SYSTEMS AND METHODS OF REDUCING STUCCO CRACKS AT DOORS AND WINDOWS

BACKGROUND OF THE INVENTION (1) Field of the Invention

The invention generally relates to means and methods within the construction industry for installing lath and applying plaster material, also known as stucco. More specifically, disclosed embodiments disclose means and methods of applying stucco systems to eliminate or reduce subsequent cracks that often originate at doors and windows.

(2) Description of the Related Art

Lath and stucco material combine to form an integral unit. First, the walls of the structure are waterproofed during the lathing process with two layers of grade D paper or equivalent. Next, a metal lath is installed and secured with 1¼ staples with the intended purpose of providing an ideal surface to support the plaster material. Stucco usually consists of a three coat system with a thickness of ⅞" and is applied in the following sequence: scratch coat, brown coat and finish coat. This wet cementitious material may crack during the drying process, or more often may crack as a result of building settlement or movement. Cracks most often develop at or near window and door corners where building movements become unevenly dispersed.

The prior art of installation of control joints on exterior stucco walls is often used in an effort to minimize cracks in large or long stucco panels. Although not intentionally created for this purpose, they can also be used at doors and windows. However, control joints add time and expense during the lathing process because several hours of labor are necessary to ensure that it is properly installed. Also, the fact that the product is visible upon finalizing the stucco system may reduce the design appeal of the end product, thereby deterring some builders or architects from using it.

The prior art often resorts to a synthetic material used in acrylic finish coats which may stretch to some extent with building movement and reduce the likelihood of hairline cracks. Unfortunately, exterior acrylic finish coats often fail to exhibit the necessary flexibility to remain intact since most structural cracks develop in the scratch coat and move outward toward the finished surface. Therefore, the superficial nature of acrylic finishes alone cannot hide most structural cracks. Consumers are also discouraged from incorporating this product into the stucco system because of the high cost associated with using it. Another possible setback in opting for an acrylic finish, due to its highly visible nature, is the potential conflict between the desired aesthetic outcome and the need to reduce significant cracks.

More recently, the prior art involving new base and mesh systems have been advocated by various stucco trade organizations that employ polymer-modified coatings which are applied over the brown coat. Such solutions deal with the general field of stucco walls and teach away from specially addressing door or window corners. It is important to note that using a reinforcing fiber mesh embedded in a base coat is very costly, since it requires another coat of material to be applied over the whole structure. This option is many times presented to customers by plastering contractors, although due to the additional time and cost it is usually declined. When accepted, the success of the mesh system is most effective in controlling minor cracks on large, uninterrupted surfaces and not at locations of most stress, specifically openings with square corners. See Base and Mesh Systems for Crack Reduction (March 2011) Stucco Manufactures Association, Newport Beach, Calif.

The trend in the art is to use prior art base coats with newer polymer-modified coatings as described in literature by Merlex for their BaseX product line. The known prior art patent literate described below discloses various large scale control joint methods that do nothing to address building movements at door or window corners.

U.S. Pat. No. 1,355,756 issued on Oct. 12, 1920 to Earley is entitled "Flexible Joint for Stuccoed Buildings" discloses a spacer system to create an air space near doors and windows to allow surrounding stucco work to move without directly pressing upon stucco applied over door or window joints. The product is very similar to a casing bead around a frame, in that it functions more as a plaster stop and does not distribute the concentration of stress that accumulates and is released at the corners of windows and doors; thus cracks still form.

U.S. Pat. No. 4,651,488 issued on Mar. 24, 1987 to Nicholas et al is entitled "Expansion Joint for Plaster Walls" and discloses a unitary extruded plaster screed expansion joint system to reduce stucco cracks.

U.S. Pat. No. 5,699,638 issued on Dec. 23, 1997 to Maylon is entitled "Stucco Arch Casing Bead" and discloses an arch casing bead with a mounting flange and other features to facilitate the construction of stucco archways.

U.S. Pat. No. 7,874,123 issued on Jan. 25, 2011 to Mariarz is entitled "Stop Bead for Separating Stucco Material from a Frame of a Window or Door" and discloses a slight variation to the traditional L-Bead system used to reduce the time and cost of applying stucco near a door or window. Here again, no corner provisions are considered, as the Mariarz disclosure is concerned with the speed of stucco application and not the reduction of subsequent cracks. Thus, there is a long felt need in the art for the embodiments of the present invention.

BRIEF SUMMARY OF THE INVENTION

The present invention overcomes shortfalls in the related art by presenting an unobvious and unique combination, configuration and use of circular corner systems that reduce stucco cracking often caused by building settlement or building movement. While the prior art teaches away from individual treatment of each door and window corner, the present invention focuses on each corner and eschews the prior art's penchant for long control joints. The present invention provides multiple solutions toward addressing stress cracks at corners of windows and doors, which has been neglected by prior art. First, it is small and easy to install. Second, its application in the stucco system does not interfere with the overall design since it is embedded in the scratch coat and hidden from view. Third, this new invention will improves the appeal of stucco by reducing structural cracks and increasing consumer satisfaction.

The present invention overcomes shortfalls of the prior art by directly confronting the oppositional forces exerted upon vertical and horizontal members of door and window frames caused by building movement. The prior art recognizes but yet fails to effectively address the fact that during building movement, door and window frames will buckle or move outwardly at the ninety degree angles causing a gradual or dissipated displacement of the framing members within the stucco system.

There is a long standing and pervasive problem associated with stress cracks in stucco. Cracks can occur at any one location in the stucco system, but most commonly originate at the 90 degree corners of openings that are used for the installation of windows and doors; it is at these points that the greatest concentration of stress is released. Since there is a greater predisposal for the formation of structural cracks at these corner locations, the invention has been created to isolate and, thus, prevent their development at the source.

The present invention overcomes shortfalls in the art by using and producing a circular corner element that provides additional strength to stucco at each window or door corner, provides a dissipated displacement of stucco movement that spans to either side of a door or window corner, separates movement of framing members from stucco at corners, provides a flexible back bone to stucco at corners, provides a flexible contact to either side of corner and other advantages and attributes as described and illustrated herein.

Disclosed circular corner elements may comprise circular voids that help to more evenly disperse stucco movement around either side of a corner, in stark contrast to the prior art wherein moving stucco strikes a horizontal and/or vertical corner framing member, causing the stucco to heave and crack. The circular voids may be positioned in radial form, starting from a center circular void and positioned outwardly in the approximate form of concentric circles. The length of the circular voids may be varied and/or staggered so as to allow a circular corner element to flex in a myriad of shapes so as to further dissipate and displace the movement of stucco.

Disclosed circular corner elements may comprise staple or attachment areas sometimes referred to as nail flanges that are lowered so as to provide secure attachment over metal lath or chicken wire. The staple areas or the surface area of a nail flange may be defined by circular walls to accommodate inward or outward flexing of a circular corner element. The circular walls defining a nail flange may transition the lower elevation of an attachment surface area to the higher elevation of a raised top surface. A raised top surface of a corner element adds material to the component and assists in absorbing, deflecting and dissipating stucco movement. The lower elevations of the nail flange fastening surface provide a more direct and close attachment to a building substrate.

Disclosed circular corner elements may comprise corner receiving areas which may comprise two frame leg sections that are touching or adjacent to vertical and horizontal frame members of a window or door. Each frame leg section may comprise one or more bumper nodes that may touch or rest adjacent to vertical and horizontal frame members of a window or door.

Disclosed circular corner elements may comprise a back side that may be attached to a building envelope, a top side that will face toward the exterior of the building, a raised top side to define circular voids and to give the corner element greater flexibility including torsional flexibility.

Disclosed embodiments include a system of use or construction wherein a building envelope may comprise a plywood substrate or other surface, covered with double D grade paper or other membrane. The building surface may be wrapped with building wire, sometimes known as "chicken wire" but is often 1½×17 gauge wire or 3.5 lbs. expanded metal lath.

The next step may include the placement of disclosed circular corner elements at door and window corners, the corner elements secured by staples driven into one or more nail flanges, with the staples passing through the chicken wire and penetrating into the building paper, plywood substrate or other components.

The stapling of a circular corner element as described comports with and even complements building codes that require metal lath to be aptly stapled to the substrate. The additional staples to secure a corner element in no way violates or otherwise compromises the spirit of applicable building codes.

The next step may include the application of a first coat or scratch coat over the building paper, metal lath and corner elements. The material of the scratch coat may penetrate voids of the corner elements. Such voids may include a center void, a plurality of circular voids and circle voids. Subsequent coats may be applied as usual. But, the use of control joints and other prior art methods of crack mitigation may be reduced or eliminated.

REFERENCE NUMERALS IN THE DRAWINGS

Figure 1:
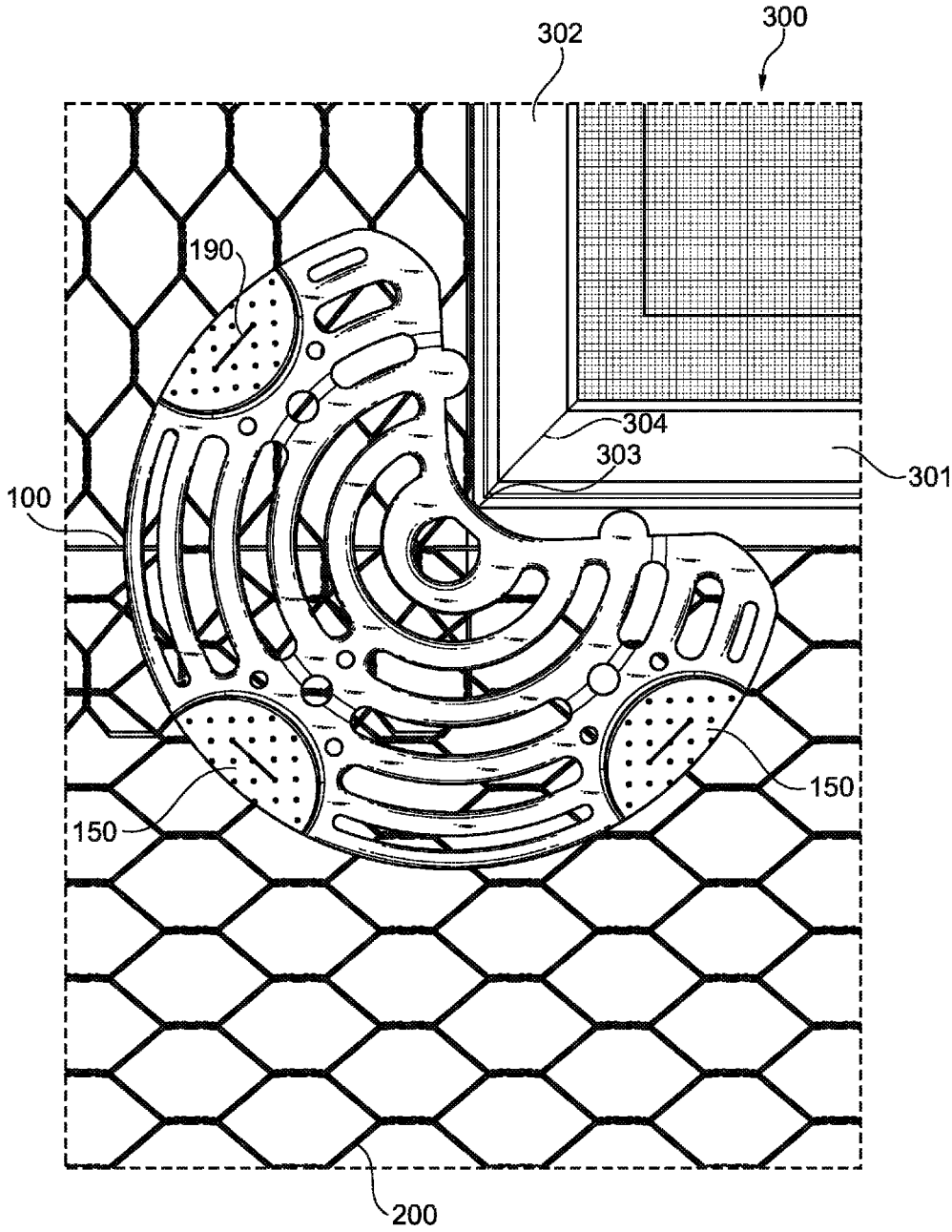
FIG. 1 depicts a disclosed system and method as integrated with wire and a door or window frame

100 a corner element in general
101 a center void found in a center area of a corner element 100
102 a circular void area defined by a corner element
103 a circle void defined by a corner element and sometimes found between circular void areas 102
104 perimeter edge of a corner element 100
150 a nail flange or attachment area found at the perimeter of a corner element
151 a circular wall defining the boundary of a nail flange
153 nail flange voids sometimes found within a fastening surface or surface area 154 of a nail flange 150
154 surface area of nail flange, sometimes called a fastening surface area and sometimes lower in elevation as compared to a raised top surface 170 of a corner element
170 a raised top surface of a corner element 100
180 a center receiving area of a corner element 100
181 frame leg sections of a corner element 100
182 bumper nodes may be found upon frame leg sections 181
185 door and window integration area
190 staples sometimes used to secure a corner element over lath wire 200
200 lath wire, also known as chicken wire
300 a window or door frame
301 a horizontal member of a window or door frame
302 a vertical member of a window or door frame
303 a corner point comprising a vertical member 302 and a horizontal member 301 of a window or door frame 300
304 a joint line between a vertical member 302 and a horizontal member 301 of a window or door frame 300
400 an expansion joint of the prior art
401 a window
500 a stucco crack of the prior art
600 exterior stucco surface
700 an alternative corner element in general

710 outer perimeter circle voids defined by an outer perimeter ring 720

720 an outer perimeter ring

730 outer notch defined within the outside edge of an outer perimeter ring 720.

740 bumper node with circle void

745 circle void within bumper node 740

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

FIG. 1 depicts a corner element 100 comprising a plurality of nail flanges 150. A window or door frame 300 is adjacent to or in contact with the corner element 100. The window or door frame may comprise a horizontal member 301, a vertical member 302 and a joint line 304, the joint line defined by the connection line shared by the horizontal member 301 and the vertical member 302. At the outer edge of the joint line 304 a corner point 303 is formed. The corner element 100 is illustrated as attached over lath wire 200 by use of staples 190. The staples are shown as secured though the nail flanges 150.

Figure 2:
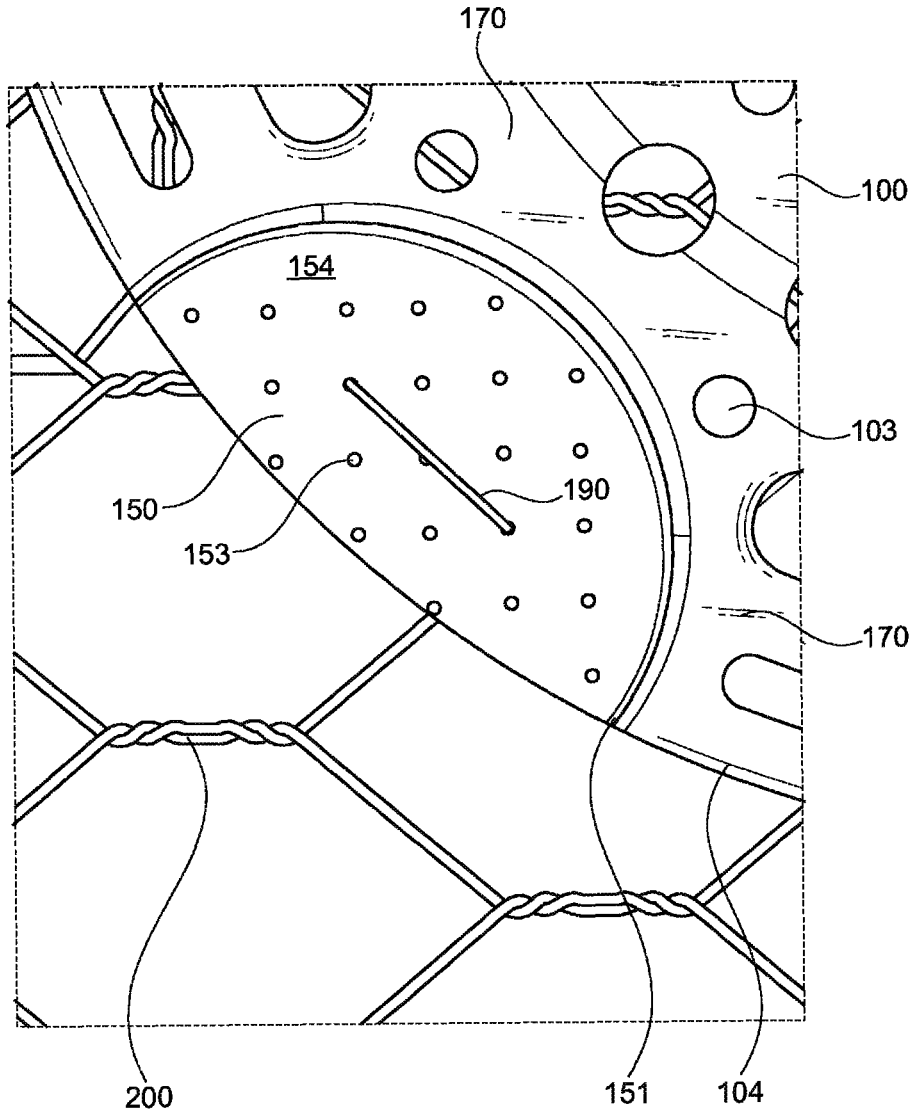
FIG. 2 depicts an expanded view of a disclosed system stapled in place

FIG. 2 depicts a corner element 100 comprising a plurality of circle voids 103, the circle voids defined by a corner element 100. A nail flange 150 is shown at the perimeter of the corner element, the nail flange comprising a surface area 154, with the nail flange surface area 154 sometimes lower in elevation as compared to the raised top surface 170 of the corner element. A nail flange 150 may be further defined by a circular or arch shaped circular wall 151. The top portion of the nail flange circular wall may be on the same plain as the raised top surface 170 of the corner element. A nail flange 150 may comprise nail flange voids 153 defined by the surface area 154 of the nail flange. The nail flange voids may assist in integrating a wet stucco coat to the corner element and may assist in adding support and flexibility to attached stucco.

Figure 3:
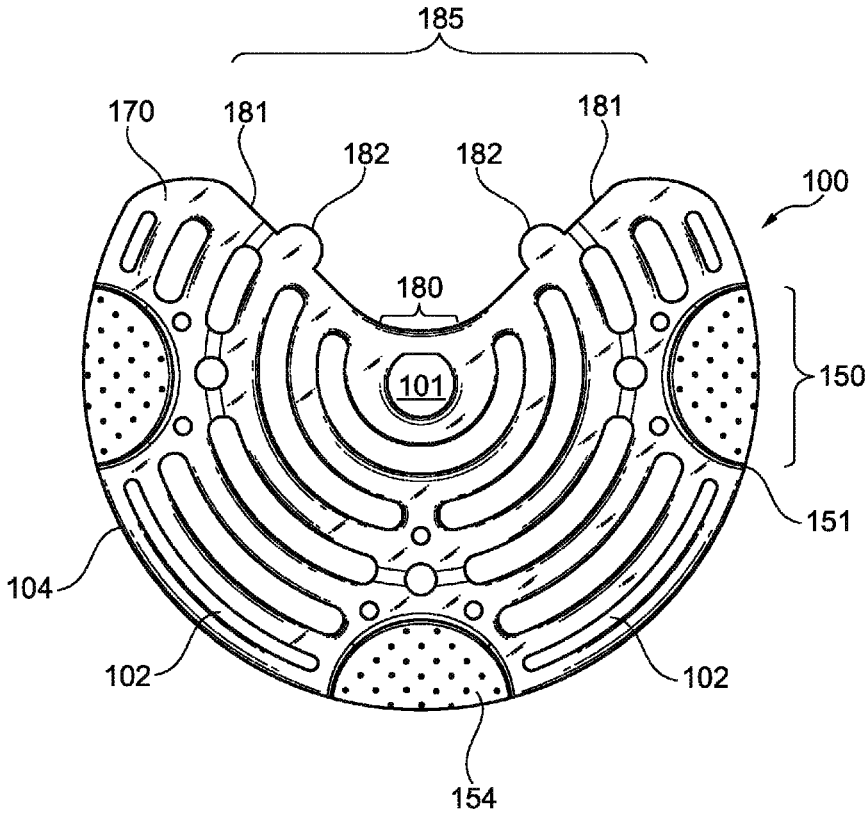
FIG. 3 depicts a disclosed system

FIG. 3 depicts a corner element 100 comprising a perimeter edge 104, a plurality of nail flanges 150, with each nail flange having a nail flange surface area 154. A nail flange surface 154 area may be lower in elevation as compared to a raised top surface 170 sometimes found in the general field of a corner element. An elevational change may occur at a nail flange circular wall 151. A circular wall 151 of the nail flange may define a medial boundary of a nail flange. A corner element perimeter edge 104 may define a distal boundary of a nail flange 150. For purposes of clarity, components closer to the center void 101 are sometimes considered medial while components closer to perimeter edge 104 are sometimes considered distal.

FIG. 3 further depicts a plurality of circular void areas 102 defined by or defined within a corner element 100. Circular void areas 102 aid in the reduction of stucco cracks by a number of physical factors. In some embodiments, circular void areas 102 sometimes take the shape of partial concentric circles with a center point found within a center void 101. The concentric configuration of circular voids 102 results in areas of stucco attachment and support that are perpendicular to the typical stucco cracks originating at doors and windows. The concentric configuration of the circular voids 102 results in more evenly dissipated movement of stucco and thus greatly reduces resulting cracks. The concentric configuration of the circular voids 102 results in a stucco base coat or scratch coat entering the circular voids and integrating the corner element.

In order to retain a correct combination of rigidity and flexibility, circular voids 102 are defined on either end by corner element material. For added flexibility and absorption of stucco movement, circle voids 103 are sometimes placed between circular voids 102.

Advantages in preventing or reducing stucco cracks are also found by the relatively lower elevation of the surface areas 154 of a nail flange 150. By use of a lower elevation of the flange surface area 154 a more direct attachment may be obtained with an underlying substrate. The lower elevation flange surface area 154 also moderates flex of the nail flange to help keep a staple 190 is secure attachment.

Advantages in preventing or reducing stucco cracks are also found by having a raised top surface 170, sometimes having a relatively higher elevation and thickness as compared to the nail flange surface area 154. The higher elevation of the raised top surface 170 allows for added material to define and support the center void 101, the circular void areas 102 and the circle voids 103. The added depth by use of a raised top surface 170 may also assist in giving the corner element an ability to flex in areas between the nail flanges.

The raised wall area or circular wall 151 defining the medial boundary of the nail flange may provide a torsional advantage in deflecting or dispersing stucco movement.

A corner element may also comprise artful integration with a door or window corner section by use of a door or window integration area 185. The integration area 185 may comprise two frame leg sections 181 with each frame leg section starting at a perimeter edge 104 and terminating at or near a center receiving area 180. A center receiving area 180 may be centered upon a center void 101. Each frame leg section 181 may comprise one or more bumper nodes 182. The use of bumper nodes 182 assists in the artful alignment of the corner element to a window or door frame. The bumper nodes 182 may also add an extra element of stucco support and disbursement of stucco movement. A center receiving area 180 is sometimes curved so as to further disburse stucco movement at a window or door corner. The center receiving area 180 may flex left, right, up or down to further dissipate the buckling forces commonly encountered by stucco at door and window corners.

Figure 9:
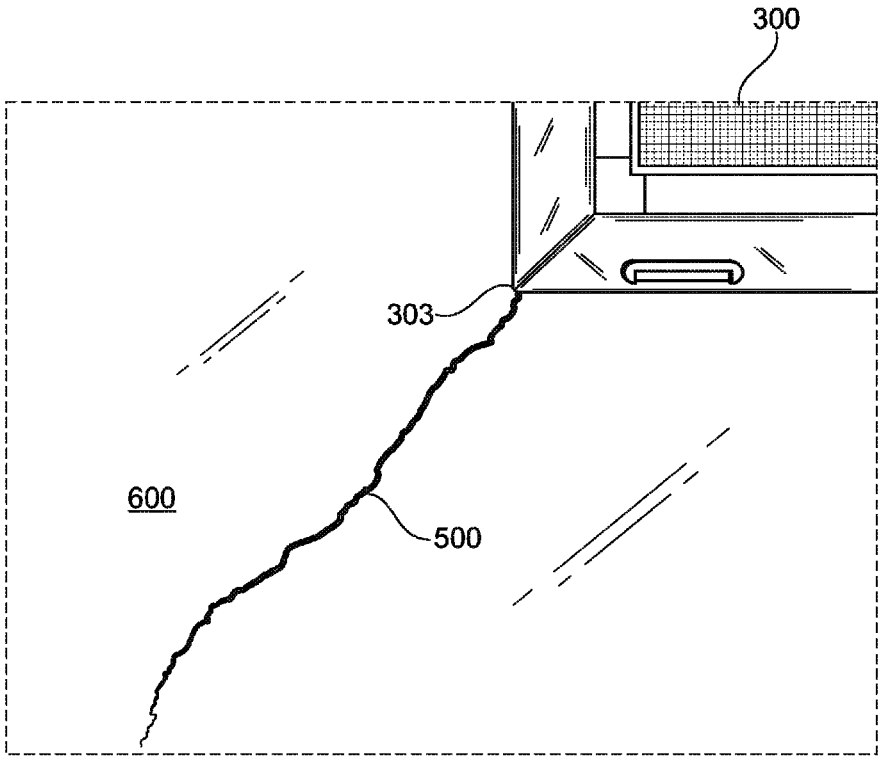
Fig. 9 Prior Art
FIG. 9 depicts a corner crack of the prior art

The center receiving area 180 is sometimes configured to be adjacent or relatively near the center void 101 or center area of the corner element. Such a configuration provides rotational support and retardation of movement in directions perpendicular to common stucco cracks at doors and windows. Such a common stucco crack 500 is seen in FIG. 9.

In the best mode known to date, a corner element 100 or alternative corner element 700 is comprised of high density polyethylene. Such material is semi-rigid, allowing for an optimal degree of flexibility to evenly disperse stucco movement. The material is strong enough to provide further stucco support and reinforcement when the corner element is embedded in plaster. In the best mode known to date, the corner element height is $2/5^{ths}$ of an inch in width such that the corner element is embedded in approximately the center of a $7/8^{ths}$ of an inch stucco application.

Further advantages of the disclosed embodiments include the use of smooth rolled edges and circular lines which redistribute stress or stucco movement or compression evenly over the corner element and related components. A configuration of concentric circular voids in the shape of slots originates from the center with each concentric circular void distal from the center point, resulting in concentric circular voids or concentric slots positioned at right angles to the corner section of a door or window.

Figure 4:
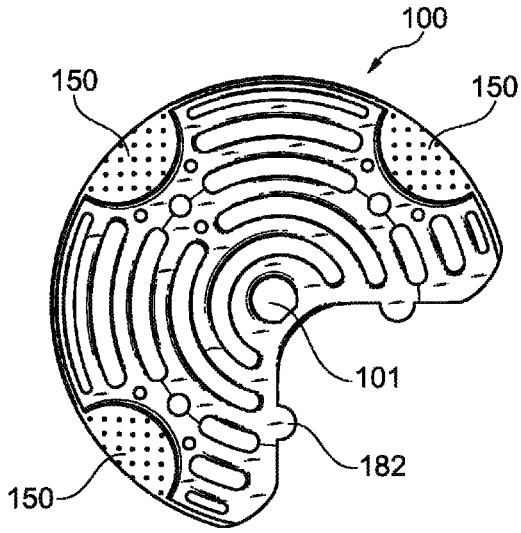
FIG. 4 depicts a disclosed system

FIG. 4 depicts a disclosed corner element 100 comprising a plurality of nail flanges 150, a center void 101 and two bumper nodes 182

Figure 5:
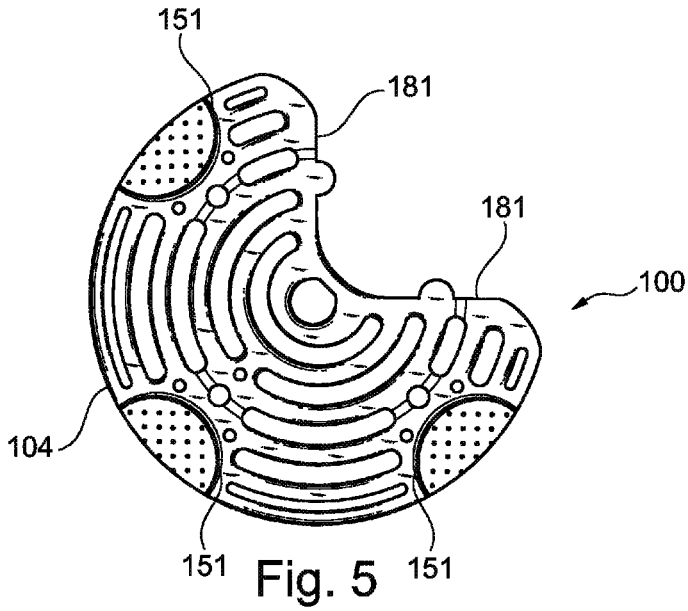
FIG. 5 depicts a disclosed system

FIG. 5 depicts a disclosed corner element 100 comprising a perimeter edge 104, a plurality of circular walls 151 and two frame leg sections 181.

Figure 6:
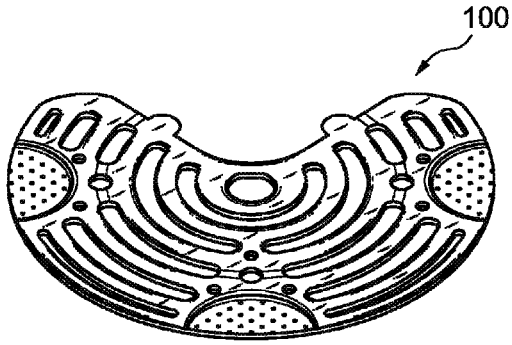
FIG. 6 depicts a disclosed system
Figure 7:
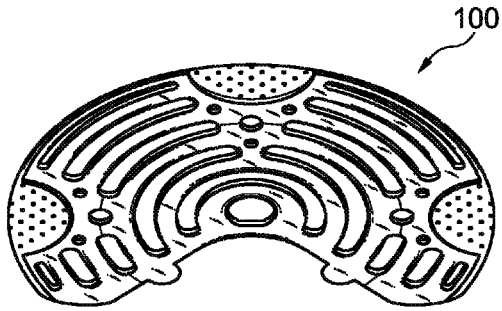
FIG. 7 depicts a disclosed system

FIG. 6 and FIG. 7 depict disclosed corner elements.

Figure 8:
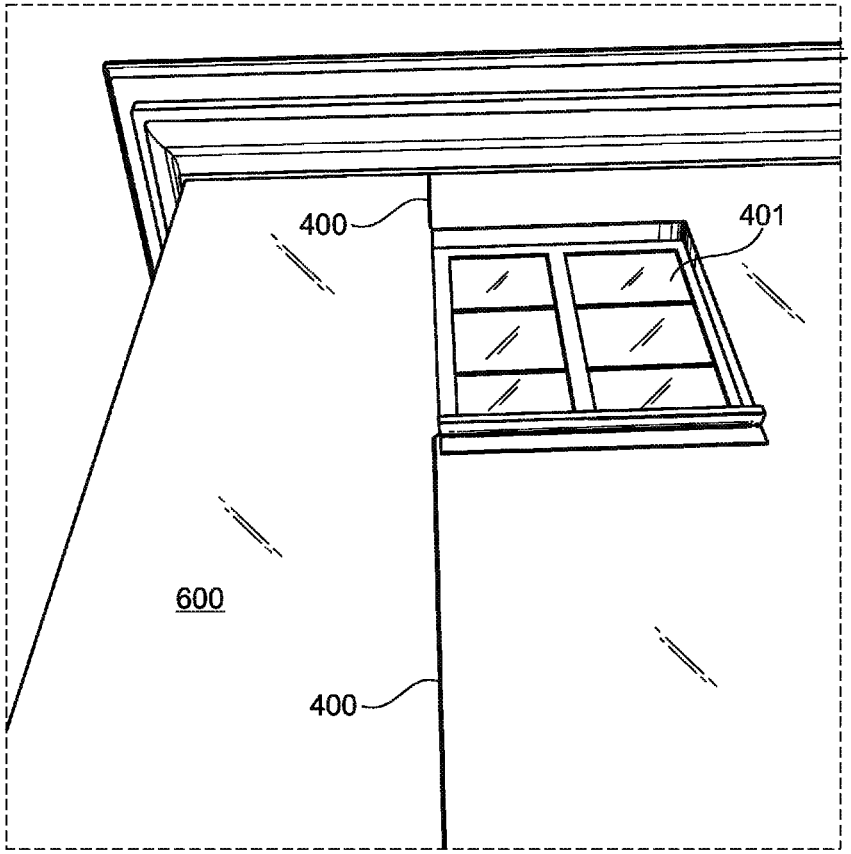
Fig. 8 Prior Art
FIG. 8 depicts an expansion joint of the prior art

FIG. 8 depicts a building comprising a window 401 with a vertical expansion joint 400 of the prior art. The vertical expansion joint 400 of the prior art detracts from the esthetic appeal of using stucco as an exterior covering.

FIG. 9 depicts a stucco crack 500 originating at a corner point 303 of a window or door frame 300. The stucco crack 500 is seen upon the exterior stucco surface 600.

Figure 10:
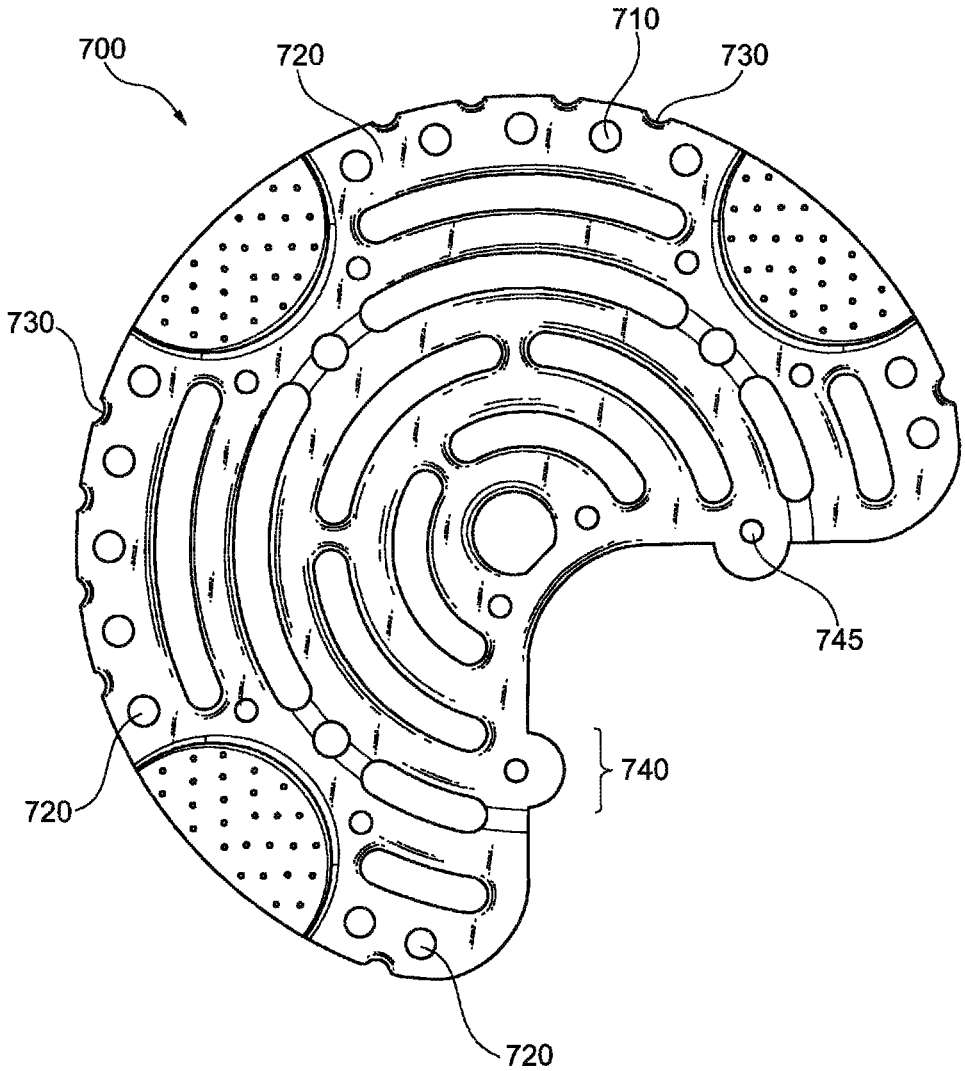
FIG. 10 depicts a disclosed system with circular voids at the perimeter

FIG. 10 depicts an alternative corner element 700 sometimes comprising outer perimeter circle voids 710, the circle voids defined within or by an outer perimeter ring 720. An alternative corner element 700 may also comprise one or more outer notches 730 defined within or by the outside edge of an outer perimeter ring 720. An alternative corner element 700 may also have bumper nodes 740 having circle voids 745. The overall configuration of alternative corner element 700 reduces stucco cracks in many ways, including the use of extra voids and outer notches 730. The outer perimeter circle voids 710 help to integrate the stucco into the corner element. The outer notches 730 increase the perimeter surface area of the corner element aiding in the integration of the corner element into a stucco system.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms.

Items

Disclosed embodiments include the following items:

Item 1. A system to reduce stucco cracks, the system comprising:

a corner element 100 defined within an arched perimeter distal edge 104 and two frame leg sections 181, the corner element further comprising:

i. a plurality of nail flanges 150 the nail flanges defined by a medial circular wall 151 and the perimeter distal edge 104;

ii. a plurality of circular void areas 102 defined by the corner element, the circular void areas comprised of concentric particle circles;

iii. a window and door integration area 185 comprising two frame leg sections 181 and a center receiving area 185, each frame leg section 181 having a first end attached to the perimeter edge 104 and having a second end attached the center receiving area 180.

Item 2. The system of item 1 wherein each nail flange comprises a fastening surface area 154 and wherein the medial circular walls 151 of each nail flange have a lower end level with the fastening surface area and a higher end level with a raised top surface 170 of the corner element.

Item 3. The system of item 2 further comprising a center void 101 defined within a center area of the corner element 100.

Item 4. The system of item 3 further comprising a bumper node 182 attached to each frame leg section 181.

Item 5. The system of item 4 further comprising a plurality of circle voids 103 defined within the raised top surface 170 of the corner element 100.

Item 6. The system of item 5 further comprising a plurality of nail flange voids 153 defined within the surface area 153 of each nail flange 150.

Item 7. The system of item 5 further comprising a plurality of outer perimeter circle voids 710 defined by an outer perimeter ring 720.

Item 8. The system of item 5 further comprising a plurality of outer notches 730 defined within an outside edge of the outer perimeter ring 720.

Item 9. The system of item 5 further comprising a plurality of bumper nodes 740 with each bumper node defining a circle void 745.

Item 10. A method of reducing stucco cracks, the method comprising:

a) attaching a corner element 100 at a corner point 303 of a door or window; and b) applying a coat of stucco material over the corner element 100.

Item 11. The method of item 10 including the step of filling voids of the corner element with the stucco coat.

Item 12. The method of item 11 including the step of securing the corner element 100 by use of a plurality of fasteners set through nail flanges of the corner element.

Item 13. The method of item 12 including the step of using a raised top surface 170 of the corner element to define a plurality of circular void areas.

Item 14. The method of item 13 using a corner element 700 comprising a plurality of outer perimeter circle voids 710 defined by an outer perimeter ring 720.

Item 15. The method of item 14 using a corner element further comprising a plurality of outer notches 730 defined within an outside edge of the outer perimeter ring 720.

What is claimed is:

1. A system to reduce stucco cracks, the system comprising:

a corner element defined within an arched perimeter distal edge and two frame leg sections, the corner element further comprising:

i. a plurality of nail flanges the nail flanges defined by a medial semi circular wall and the perimeter distal edge;

ii. a plurality of circular void areas defined by the corner element, the circular void areas comprised of concentric partial circles;

iii. a window and door integration area comprising two frame leg sections and a center receiving area, each frame leg section having a first end attached to the perimeter edge and having a second end attached the center receiving area.

2. The system of claim 1 wherein each nail flange comprises a fastening surface area and wherein the medial circular walls of each nail flange have a lower end level with the fastening surface area and a higher end level with a raised top surface of the corner element.

3. The system of claim 2 further comprising a center void defined within a center area of the corner element.

4. The system of claim 3 further comprising a bumper node attached to each frame leg section.

5. The system of claim 4 further comprising a plurality of circle voids defined within the raised top surface of the corner element.

6. The system of claim 5 further comprising a plurality of nail flange voids defined within the surface area of each nail flange.

7. The system of claim 5 further comprising a plurality of outer perimeter circle voids defined by an outer perimeter ring.

8. The system of claim 5 further comprising a plurality of outer notches defined within an outside edge of the outer perimeter ring.

9. The system of claim 5 further comprising a plurality of bumper nodes with each bumper node defining a circle void.

10. A method of reducing stucco cracks, the method comprising:

a) attaching a corner element of claim 1 at a corner point of either a door or a window; and b) applying a coat of stucco material over the corner element.

11. The method of claim 10 including the step of filling voids of the corner element with the stucco coat.

12. The method of claim 11 including the step of securing the corner element by use of a plurality of fasteners set through nail flanges of the corner element.

13. The method of claim 12 including the step of using a raised top surface of the corner element to define a plurality of circular void areas.

14. The method of claim 13 using a corner element comprising a plurality of outer perimeter circle voids defined by an outer perimeter ring.

15. The method of claim 14 using a corner element further comprising a plurality of outer notches defined within an outside edge of the outer perimeter ring.

* * * * *